US005209040A

United States Patent [19]

Yamamoto et al.

[11] Patent Number: 5,209,040

[45] Date of Patent: May 11, 1993

[54] CAPSULE SEALING APPARATUS

[75] Inventors: Taizo Yamamoto, Osaka; Masakiyo Inoue, Nara; Yoshihisa Kawaguchi, Kashihara, all of Japan

[73] Assignee: Nippon Elanco Kabushiki Kaisha, Osaka, Japan

[21] Appl. No.: 915,084

[22] Filed: Jul. 16, 1992

[30] Foreign Application Priority Data

Jul. 19, 1991 [JP] Japan ..... 3-179958

[51] Int. Cl.[5] ..... B65B 51/02; B65B 61/00

[52] U.S. Cl. ..... 53/137.2; 53/131.1; 53/376.2; 118/224; 118/233

[58] Field of Search ..... 53/131.1, 137.2, 376.2, 53/485, 454, 560, 411, 419; 156/69; 118/219, 224, 233, 16, 212, 216

[56] References Cited

U.S. PATENT DOCUMENTS 3,108,712 10/1963 Hall ..... 53/137.2 X
4,793,119 12/1988 Maso ..... 53/137.2
4,802,323 2/1989 Garris et al. ..... 53/53
5,054,258 10/1991 Tait et al. ..... 53/137.2
5,094,184 3/1992 Yamamoto et al. ..... 53/376.2 X

FOREIGN PATENT DOCUMENTS 0154966 9/1985 European Pat. Off. .

*Primary Examiner*—Horace M. Culver
*Attorney, Agent, or Firm*—Renner, Otto, Boisselle & Sklar

[57] ABSTRACT

A capsule sealing apparatus is provided which includes a capsule supplying device, a slat, a capsule conveyor unit, a capsule sealing device, a plurality of capsule retaining plates, a drying device, and a capsule discharging device. The capsule supplying device intermittently supplies a prescribed number of capsules at a time. The slat includes a plurality of capsule resting slits for individually accommodating the capsules. The capsule conveyor unit linearly reciprocates the slat, during which the capsules are individually accommodated in respective capsule resting slits. The capsule sealing device coats the seams of the capsules with a sealing liquid through the openings at the bottoms of the slits in the slat. The capsule retaining plates receives all the capsules thereon. The drying device vertically circulates the capsule retaining plate with the charged capsules thereon in the horizontal posture so as to dry the sealing liquid applied on each capsule. The capsule discharging device discharges the capsules outside the drying device.

6 Claims, 5 Drawing Sheets

CAPSULE SEALING APPARATUS

BACKGROUND OF THE INVENTION

1. Field of the Invention:

The present invention relates to a capsule sealing apparatus, and more particularly to an apparatus for sealing the seams between the caps and bodies of capsules containing powdery, granular, or liquid pharmaceutics, foodstuffs, or the like so that the caps and bodies cannot be separated from each other.

2. Description of the Prior Art:

In the prior art, powdery, granular, or liquid pharmaceutics have been charged in capsules made of hard gelatin so that patients can swallow them with ease. The capsules of hard gelatin have a hollow cylindrical body to be charged with contents, and a hollow cylindrical cap, having a slightly larger diameter than body, to be combined with one end portion of the body. The body is fitted in the cap after the body is charged with contents.

When the contents in the capsules are in a liquid or fine particle form, the contents are likely to leak from the spaces at the seams between the caps and the bodies.

In recent years, illegalities have been reported where the caps have been separated from the bodies of capsules and the contents adulterated with foreign matters. Therefore, after capsules are charged with contents, the seams between the caps and the bodies of the capsules are sealed so that the caps cannot be separated from the bodies.

There have been disclosed apparatuses for automatically sealing charged capsules, one of which is disclosed in Japanese Patent Publication No. 2-946 in which many slats on which a plurality of capsules are mounted in row are horizontally conveyed successively, while the seams of the capsules mounted on respective slats are automatically sealed. The many slats in the aforesaid capsule sealing apparatus are connected with each other in an endless chain so as to circulate. Each slat has a plurality of capsule resting slits for accommodating capsules aligned in a direction orthogonal to the circulating route, and is horizontally moved in a horizontal posture, after which the slat is moved in the opposite direction below the moving area thereof.

The capsules charged with contents are successively fed into respective capsule resting slits of each slat with their caps and bodies aligned in the same direction, respectively. Each capsule resting slit is open at its bottom, and capsules in respective slits are supported by a supporting plate separate from the slats, and the capsules in each slit of a slat are horizontally conveyed while rolling on the supporting plate by the movement of each slat.

Thus, the capsules accommodated in the slits of each slat are conveyed while rotating on their axes, and are coated with a sealing liquid in a sealing liquid vessel along the seams between the bodies and caps by means of a coating roller partially submerged in the sealing liquid. Then, while each slat is circulated, the sealing liquid is dried, thereby sealing the seam of each capsule.

Japanese Laid-Open Patent Publication No. 3-12160 discloses another apparatus for automatically sealing a capsule using many slats. The many slats in the aforesaid capsule sealing apparatus are annularly arranged within a horizontal plane around a chain running on a pair of horizontal sprockets, and the circulation of the chain circulates the slates always in their horizontal posture. Each slat has a plurality of slits with openings at their bottoms that can accommodate a plurality of capsules aligned in a direction orthogonal to the circulating route.

Capsules charged with contents are successively fed into the capsule resting slits of each slat with the caps and bodies aligned in the same direction, respectively. The capsules in respective capsule resting slits are horizontally conveyed by the movement of each slat to pass over a coating roller, in the course of which the coating roller comes in contact with the seams of the capsules in the slits through the openings at the bottoms of the slits. This causes the capsules to rotate on their axes, and to be coated with a sealing liquid along the seams thereof. The capsules coated with the sealing liquid are dried during the circulation of each slat, thus sealing the seam.

In these conventional capsule sealing apparatuses employing many slats, it is necessary that the velocity at which the slats circulate is increased so as to increase the number of capsules to be treated per hour. However, if the velocity is increased, the capsules pass through the area where the sealing liquid applied on the capsules is dried at high speed. Therefore, it is necessary that the drying area is increased in order to ensure the time for drying the sealing liquid. If the drying area is increased, the number of slats is also increased. However, the slats for retaining capsules require a minute structure in any capsule sealing apparatuses mentioned above, resulting in a high manufacturing cost. The increase in number of slats having a minute structure also leads to loss in cost, and requires a lot of time for adjusting each slat.

SUMMARY OF THE INVENTION

The capsule sealing apparatus of this invention, comprises a capsule supplying device for intermittently supplying a prescribed number of capsules aligned in the same direction at a time, each capsule including a cap and a body, and charged with contents with the cap closing the body;

a slat including a plurality of capsule resting slits for individually accommodating the capsules supplied from the capsule supplying device, each capsule resting slit including an opening at its bottom;

a capsule conveyor unit for linearly reciprocating the slat, the capsules supplied from the capsule supplying device being individually accommodated in respective capsule resting slits during the travel of the slat;

a capsule sealing device for coating the seams between their caps and bodies of the capsules individually accommodated in respective capsule resting slits with a sealing liquid through the openings at the bottoms of the slits in the slat, the capsule sealing device being disposed in an area where the slats are moved by the capsule conveyor unit;

a plurality of capsule retaining plates onto which all the capsules in each capsule resting slit of the slat are transferred, the plates horizontally being disposed at a return point of the slat;

a drying device for vertically circulating the capsule retaining plate with the charged capsules thereon in the horizontal posture so as to dry the sealing liquid applied on each capsule; and a capsule discharging device for discharging the capsules outside the drying device, the sealing liquid of the capsules being dried on the capsule retaining plate of the drying device.

In the capsule sealing apparatus of the present invention, a prescribed number of capsules supplied from the capsule supplying device are intermittently conveyed to the drying device by the capsule conveyor unit using a slat, in the course of which the capsules conveyed on the slat are coated along the seams between the bodies and the caps with a sealing liquid by the capsule sealing device. All the capsules on the slat in the drying device are transferred onto the capsule retaining plate. Then, the slat is returned to the original position where capsules supplied from the capsule supplying device can be accommodated therein, during which the capsule retaining plate is moved to the position where the plate can vertically circulate, and is vertically circulated. Such operation is repeated.

Thus, the invention described herein makes possible the advantages of (1) providing a capsule sealing apparatus which can treat capsules at high speed; (2) providing a capsule sealing apparatus which can be readily manufactured at low cost; (3) providing a capsule sealing apparatus having a simplified construction; and (4) providing a capsule sealing apparatus whose capability of treating capsules can readily be improved.

These and other advantages of the present invention will become apparent to those skilled in the art upon reading and understanding the following detailed description with reference to the accompanying figures.

DESCRIPTION OF THE PREFERRED EMBODIMENT

The present invention is described in detail by reference to the example below.

EXAMPLE

Figure 2:
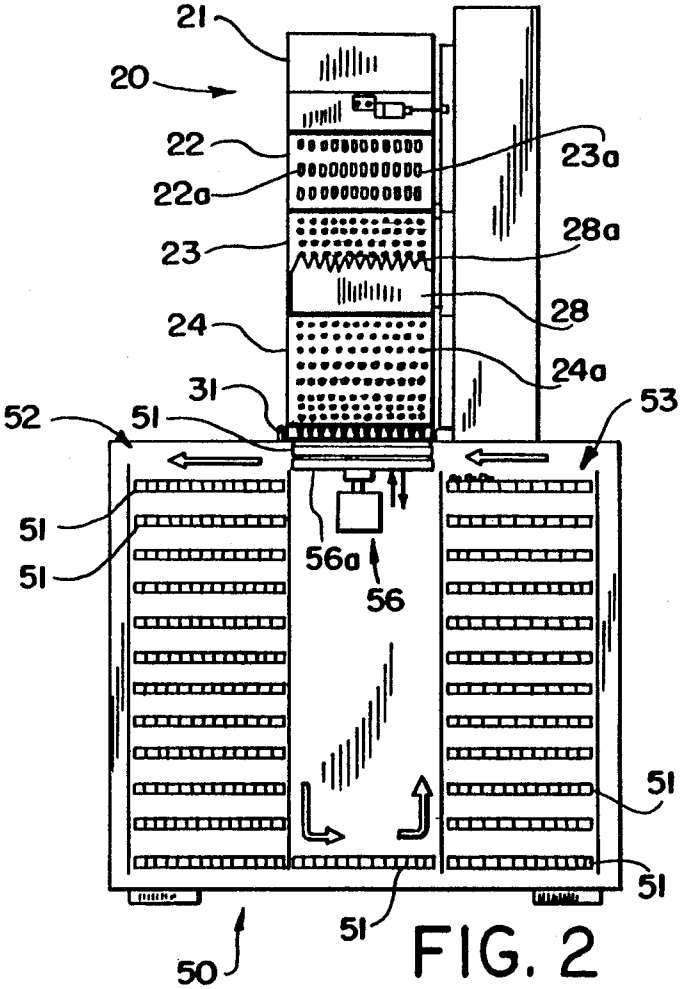
FIG. 2 is a front view showing the capsule sealing apparatus.
Figure 1:
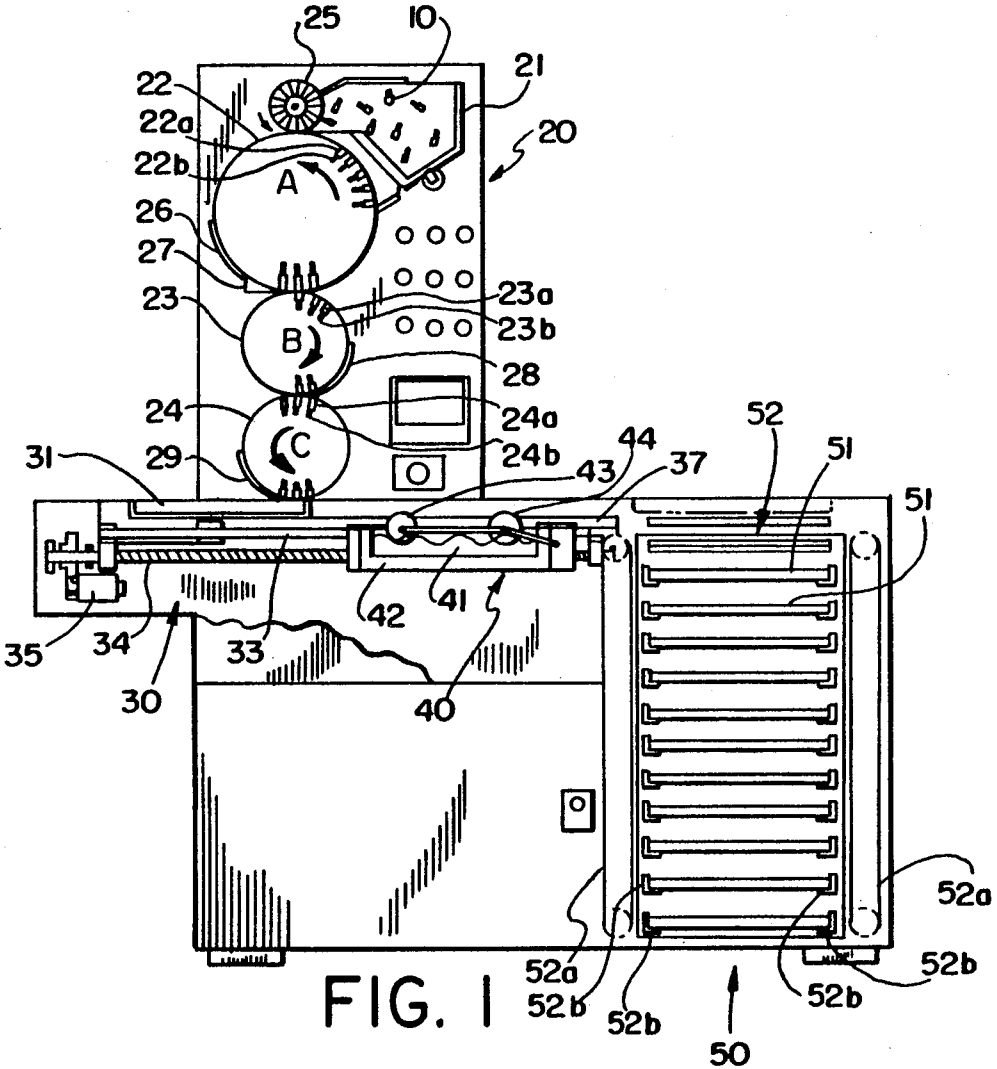
FIG. 1 is a side view showing a capsule sealing apparatus according to the present invention.

As shown in FIGS. 1 and 2, a capsule sealing apparatus of the present invention includes a capsule supplying device 20 for intermittently supplying a prescribed number of capsules 10 containing contents in their bodies closed with their cap aligned in a prescribed direction at a time; a capsule conveyor unit 30 for horizontally conveying the capsules 10 supplied from the capsule supplying device 20; a sealing device 40 for coating the seams between their bodies and caps of the capsules 10 conveyed by the capsule conveyor unit 30 with a sealing liquid; and a drying device 50 which successively receives the capsules 10 coated with the sealing liquid along the seams and dries the sealing liquid applied on each capsule.

The capsule supplying device 20 has the same configuration as that of the capsule supplying means employed for a conventional capsule sealing apparatus disclosed in Japanese Laid-Open Patent Publication No. 3-12160 except that capsules are intermittently supplied.

The capsule supplying device 20 includes, from the uppermost, a supplying drum 22, regulating roller 23, and a contrarotating roller 24 vertically disposed and having substantially horizontal axes in parallel with each other. A capsule hopper 21 is provided opposite the upper circumferential surface of the supplying drum 22.

The capsule hopper 21 is supplied with capsules 10, which contain prescribed contents in the bodies closed with the caps.

Figure 3:
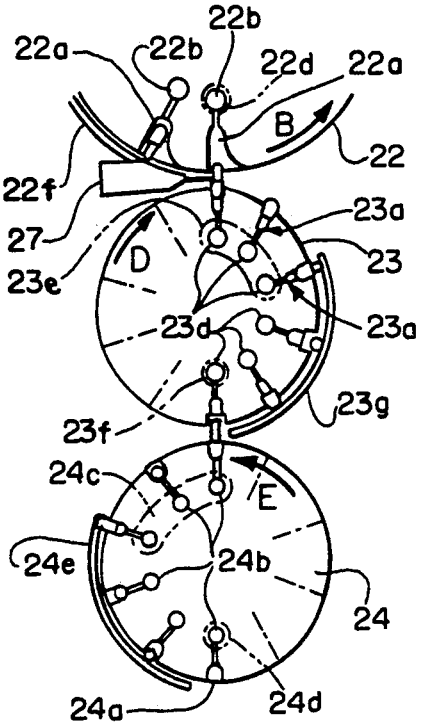
FIG. 3 is a side view showing a main portion of the capsule sealing apparatus.

As shown in FIG. 3, the supplying drum 22 can be rotated in the direction of arrow B, and is provided with many capsule accommodating pockets 22*a* extending radially of the supplying drum 22 and axially and circumferentially spaced at prescribed intervals around the entire peripheral surface thereof. Each capsule accommodating pocket 22*a* has an inside diameter sufficiently larger than the outside diameter of the caps of the capsules 10 so as to accommodate the capsules 10 supplied from the capsule hopper 21 therein. The capsule hopper 21 successively supplies the capsules 10 therein into the capsule accommodating pockets 22*a* at a point upstream of the rotation of the supplying drum 22 rather than immediately above the supplying drum 22.

Each capsule accommodating pocket 22*a* in the supplying drum 22 has an opening diverging in the direction in which the supplying drum 22 is rotated so that capsules 10 in the hopper 21 can be accommodated in respective pockets 22*a*.

As shown in FIG. 1, above the supplying drum 22, a brush roller 25 is rotatably disposed faced to the uppermost part of the supplying drum 22. The brush roller 25 has an axis in parallel with that of the supplying drum 22, and can rotate in the same direction as that of the supplying drum 22. The brush roller 25 returns excess capsules 10 left from the capsule accommodating pockets 22*a* into the capsule hopper 21.

Each capsule accommodating pocket 22*a* has a larger inside diameter than the outside diameter of the cap of each capsule 10. This enables capsules 10 in the hopper 21 to enter each capsule accommodating pocket 22*a* from either the caps or the bodies so that each capsule 10 can be radially retained.

The pockets 22*a* arranged axially with the supplying drum 22 are connected to an air passage 22*b* at their bottoms that extends axially with the supplying drum 22. At the upper part of one end face of the supplying drum 22 provided is a suction port that can be connected to the air passages 22*b*. The suction port is connected to the air passages 22*b* of the pockets 22*a* that rise up to the uppermost part of the supplying drum 22 so as to effect a reduction in a pressure therein. The suction port is connected to a suitable suction means in order to reduce the internal pressure therein, which in turn reduces the internal pressure in the air passages 22*b* connected to the suction port, and then reduces the internal pressure in the pockets 22*a* that are connected to the air passage 22*b*. This ensures that capsules 10 inserted into each pocket 22*a* are secured therein.

Figure 4:
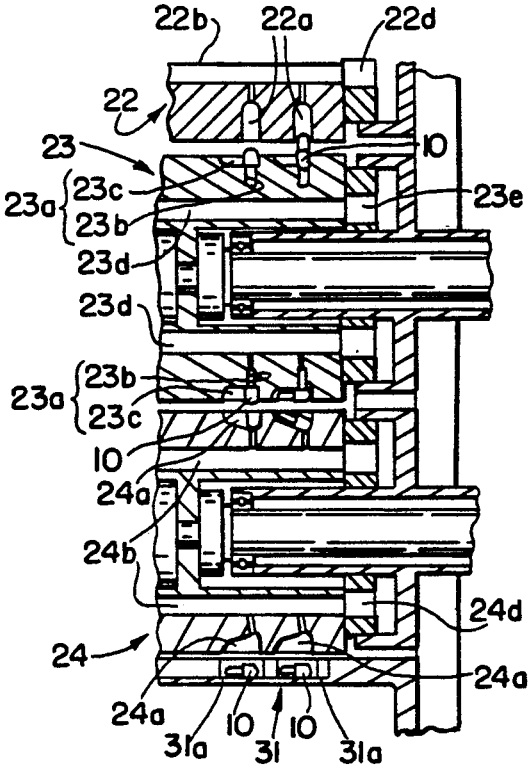
FIG. 4 is a longitudinal sectional view showing the capsule sealing apparatus.

As shown in FIGS. 3 and 4, the air passage 22*b* connected to the pockets 22*a* situated at the lowermost part of the supplying drum 22 is connected to an air supply port 22*d* disposed at the end face of the supplying drum 22. Compressed air or the like is supplied to the air supply port 22*d* through which the compressed air is supplied to the pockets 22*a* located at the lowermost part of the supplying drum 22 through the air passage 22*b* so that the capsules 10 contained in the pockets 22*a* are discharged downward.

A plate 22*f* is located adjacent to the lowermost part of the supplying drum 22 and at a point upstream of the rotation thereof, and covers the pockets 22*a* adjacent to the lowermost part of the supplying drum 22. The plate 22*f* prevents the capsules 10 accommodated in the pockets 22*a* opposite the plate 22*f* from falling.

Figure 5:
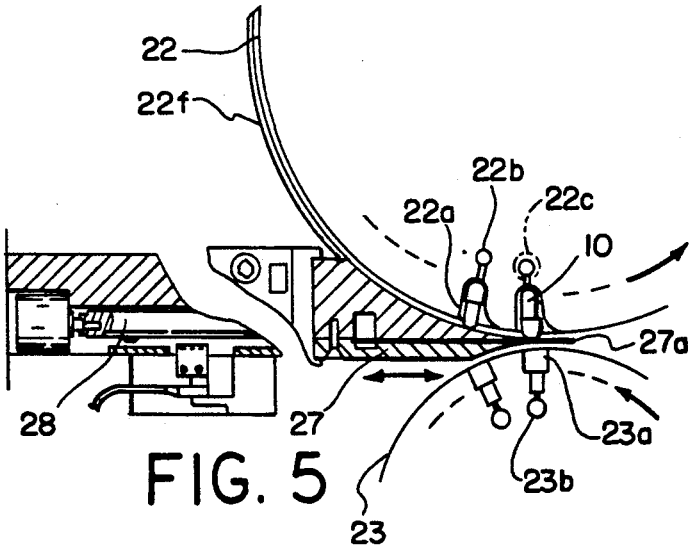
FIG. 5 is an enlarged fragmentary view showing the capsule sealing apparatus.

As shown in FIG. 5, immediately below the plate 22*f*, a shutter faces the lower peripheral surface of the supplying drum 22. The shutter 27 is in the shape of wedge with a top face curved along the peripheral surface of the supplying drum 22, and horizontally reciprocated by a cylinder 28 so that the leading edge 27*a* can insert into and withdraw from between the lowermost part of the supplying drum 22 and the uppermost part of the regulating roller 23. When the leading edge 27*a* inserts in between the lowermost part of the supplying drum 22 and the uppermost part of the regulating roller 23, capsules 10 accommodated in respective pockets 22*a* pass the lowermost part of the supplying drum 22 and run up to the upper part of the supplying drum 22 without falling off the pockets 22*a*. On the contrary, when the leading edge 27*a* of the shutter 27 withdraws from between the uppermost part of the regulating roller 23 and the lowermost part of the supplying drum 22, capsules 10 in the pockets 22*a* situated at the lowermost part of the supplying drum 22 are discharged downwards. Accordingly, the movement of the shutter 27 causes capsules 10 to be intermittently discharged from the supplying drum 22 to the regulating roller 23 in prescribed numbers at a time. An air supply passage 22*c* is connected to the air passages 22*b* connected to the pockets 22*a* situated at the lowermost part of the supplying drum 22. Compressed air is supplied to the pockets 22*a* through the air supply passage 22*c* and the air passages 22*b*, so that capsules 10 in the pockets 22*a* can be discharged downwards.

The regulating roller 23 is disposed below and in opposition to the supplying drum 22. The regulating roller 23 is rotated in an opposite direction (the direction of arrow D shown in FIG. 3) to the rotation of the supplying drum 22. The regulating roller 23 is provided with many capsule direction regulating pockets 23*a* extending axially therewith and spaced at the same intervals as those between the capsule accommodating pockets 22*a* of the supplying drum 22 on the entire peripheral surface.

The capsule direction regulating pocket 23*a* has a body supporting portion 23*b* radially extending, and a capsule bed portion 23*c* connected to the body supporting portion 23*b* and extending axially with the regulating roller 23. The inside diameter of the body supporting portion 23*b* is larger than the outside diameter of the bodies of capsules 10, but smaller than the outside diameter of the caps. Therefore, if capsules 10 are inserted from their bodies through the capsule bed portion 23*c* into the body supporting portion 23*b*, the bodies are allowed to enter the body supporting portion 23*b*. On the contrary, if capsules 10 are inserted from their caps through the capsule bed portion 23*c* into the body supporting portion 23*b*, the caps are not allowed to enter the body supporting portion 23*b*. When the bodies of capsules 10 are accommodated in the body supporting portion 23*b*, their caps are accommodated in the capsule bed portion 23*c* so that the entire capsules 10 are accommodated in the pockets 23*a*. This causes the top portions of the capsules 10 to hardly project or project a little their caps out of the regulating roller 23. In contrast, if the caps of capsules 10 are accommodated in the capsule bed portion 23*c* and the caps are opposed to the body supporting portions 23*b*, the bodies of these capsules 10 are projected out of the regulating roller 23.

The capsule bed portion 23*c* extends axially with the regulating roller 23, and therefore, capsules 10 can be accommodated therein so as to lie axially with the regulating roller 23. The body supporting portions 23*b* arranged in parallel with each other and axially with the regulating roller 23 in respective capsule direction regulating pockets 23*a* are connected to an air passage 23*d* extending axially with the regulating roller 23 at its bottom. A suction port 23*e* connected to each air passage 23*d* is provided in an area from the uppermost part of the regulating roller 23 to the downstream portion thereof at the upper part of one end face of the regulating roller 23. The suction port 23*e* is connected to an appropriate sucking means that reduces the internal pressure in the pockets 23*a* through the suction port 23*e* and the air passage 23*d*.

On the other end face of the regulating roller 23 also provided is an air supply port 23*f* connected to the air passage 23*d* of the pockets 23*a* situated at the lowermost part of the regulating roller 23. Compressed air or the like is supplied to the pockets 23*a* through the air passages 23*d* from the air supply port 23*f*. The capsules 10 contained in the pockets 23*a* are discharged downward from the pockets 23*a* under the pressure of the compressed air.

Figure 6:
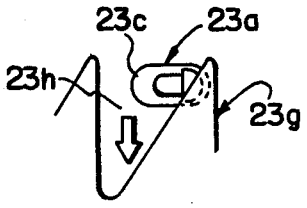
FIG. 6 is an explanatory view showing a guard plate used for a regulating roller in the capsule supplying device.

A guard plate 23*g* is provided so as to cover an area from the lowermost part of the regulating roller 23 to an upstream portion thereof in the lower part of the regulating roller 23. The guard plate 23*g* faces the lower peripheral surface of the regulating roller 23 with slight space formed therebetween. As shown in FIG. 6, in the side edge portion, of the guard plate 23*g*, upstream of the rotation of the regulating roller 23, provided are many notches 23*h* arranged axially with the regulating roller 23 that are open toward the upstream direction. The notches 23*h* are located opposite the corresponding pockets 23*a* arranged axially with the regulating roller 23, and one side wall in each notch 23*h* is slanted so that the bodies of the capsules 10 that project out of the regulating roller 23 are caused to lie down axially with the regulating roller 23 when the bodies come in contact with the side wall by the rotation of the regulating roller 23 and be accommodated in the capsule bed portion 23*c*. When the capsules 10 lie down under the guidance of the side wall of each notch 23*h*, they are accommodated in the capsule bed portions 23*c* with their caps in opposition to the body supporting portions 23*b*.

The top end portion of the guard plate 23*g* faces the bottom end portion of the suction port 23*e*, and the capsules 10 that lie down at the top end portion of the guard plate 23*g* are sucked under reduced pressure provided through the suction port 23*e* so that they are accommodated in the pockets 23*a*.

The contrarotating roller 24 disposed below the regulating roller 23 has the same configuration as that of the regulating roller 23, and rotates in the opposite direction to the rotation of the regulating roller 23 as shown by arrow E in FIG. 3, but at the same velocity as the regulating roller 23. The contrarotating roller 24 is provided with capsule accommodating pockets 24*a* on the entire peripheral surface thereof. Each capsule accommodating pocket 24*a* faces the corresponding capsule direction regulating pocket 23*a* according to the rotation of the contrarotating roller 24 and the regulating roller 23. Each capsule accommodating pocket 24*a* has a size sufficient to individually accommodate the capsules 10, and extends axially with the contrarotating roller 24 so as to enable the openings of both pockets 23*a* and 24*a* to meet.

The bottom of the capsule accommodating pockets 24*a* are slanted so as to increase the depth thereof toward the body supporting portions 23*b* in the capsule direction regulating pockets 23*a*. The bottoms of the capsule accommodating pockets 24*a* are connected to an air passage 24*b* extending axially with the contrarotating roller 24. The air passage 24*b* is connected to the deepened portion of the capsule accommodating pockets 24*a*. On one end face of the contrarotating roller 24 provided is a suction port 24*c* that can be connected to air passages 24*b* situated in an area from the uppermost portion of the contrarotating roller 24 to a portion downstream thereof.

At the uppermost portion of the contrarotating roller 24 where the suction port 24*c* is connected to the air passages 24*b* of the pockets 24*a*, the pockets 24*a* arranged axially with the contrarotating roller 24 face the corresponding capsule direction regulating pockets 23*a* situated at the lowermost part of the regulating roller 23. In this way, the internal pressure in the pockets 24*a* of the contrarotating roller 24 is reduced, and air is supplied in the pockets 23*a* of the regulating roller 23 faced to the pockets 24*a* so that the capsules 10 in the pockets 23*a* are transferred into the pockets 24*a* of the contrarotating roller 24. At this stage, when the bodies of the capsules 10 are accommodated in the body supporting portions 23*b* of the pockets 23*a*, the capsules 10 are inserted in the pockets 24*a* with their caps foremost, wherein the caps are accommodated in the deep portions of the pockets 24*a* with parts of their bodies projecting out of the contrarotating roller 24. Other capsules 10 accommodated in the capsule bed portions 23*c* of the regulating roller 23 in their lying posture are inserted into the pockets 24*a* with their caps foremost by the flow of air blown from the body supporting portions 23*b*. In this way, the caps of the capsules 10 are accommodated in the deep portions of the pockets 24*a*, wherein the capsules 10 are placed in the pockets 24*a* in the same slanting postures as the bottom of the pockets 24*a*.

Figure 7:
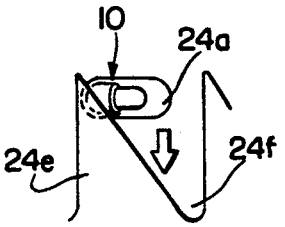
FIG. 7 is an explanatory view of a guard plate used for a contrarotating roller in the capsule supplying device.

A guide plate 24*e* is located adjacent to the lowermost part of the contrarotating roller 24 and at a point upstream of the rotation thereof. The side edge, of the guide plate 24*e*, upstream of the rotation of the contrarotating roller 24 corresponds to the lower edge of the suction port 24*c*. In the side edge, of the guide plate 24*e*, upstream of the rotation of the contrarotating roller 24, provided are notches 24*f* faced to respective pockets 24*a* arranged axially with the contrarotating roller 24 as shown in FIG. 7, which has a slanting side wall designed to cause the capsule 10 to lie and accommodate them in the pockets 24*a* in accordance with the rotation of the contrarotating roller 24 when parts of the capsules 10 project out of the contrarotating roller 24. In this way, the guide plate 24*e* ensures that once the pockets 24*a* have passed it, the capsules 10 are aligned in the prescribed direction, and accommodated therein so that the caps are situated in the deep portions of the pockets 24*a*.

At the lower part of the one end face of the contrarotating roller 24 provided is an air supply port 24*d* that is connected through the air passage 24*b* to the capsule accommodating pockets 24*a* arranged axially therewith at the lowermost part of the contrarotating roller 24. Compressed air or the like is supplied to the air supply port 24*d*, and is supplied through the air passage 24*b* to each pocket 24*a* so that the capsules 10 contained in the pockets 24*a* are discharged downwards.

The capsules 10 discharged from the pockets 24*a* are transferred to a slat 31 of a capsule conveyor unit 30 positioned below the contrarotating roller 24, wherein their caps and bodies are situated in a prescribed direction and the capsules 10 are maintained substantially horizontal with their axes in parallel with each other.

Figure 8:
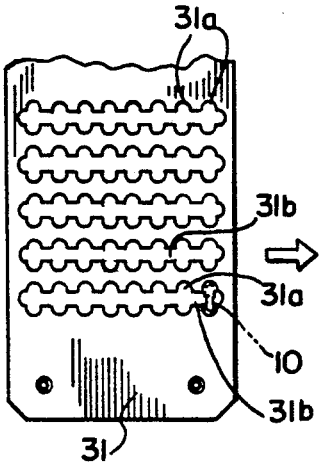
FIG. 8 is a plan view showing a slat used for a capsule conveyor unit.

The capsule conveyor unit 30 is so constructed that the slat 31 in the form of a flat plate is linearly reciprocated. The slat 31 is linearly transferred in a horizontal direction from below the contrarotating roller 24 of the capsule supplying device 20. As shown in FIG. 8, the slat 31 is provided with many capsule resting slits 31*a* spaced at intervals in a direction in which the slat is moved and in a lateral direction thereof orthogonal to the moving direction of the slat 31. The capsule resting slits 31*a* arranged in a lateral direction of the slat 31 are spaced at the same intervals as those between the capsule accommodating pockets 24*a* arranged circumferentially with the contrarotating roller 24. Each capsule resting slit 31*a* is penetrated therethrough, and slightly slants to the lateral direction of the slat 31 so that capsules 10 accommodated in each pocket 24*a* with their bodies and caps aligned respectively can be supplied therein without shifting their direction. The slat 31 is provided with slit-like openings 31*b* running through the capsule resting slits 31*a* arranged in a direction in which the slat 31 is moved. The longitudinal direction of the capsule resting slits 31*a* slants to a direction in which the slat 31 advances, so that capsules 10 are accommodated therein with their caps situated toward the longitudinal side wall positioned in the opposite direction to advance of the slat 31.

The slat 31 is slid on a support plate 37. Capsules 10 fed into the capsule resting slits 31*a* are supported by the support plate 37. The support plate 37 extends from below the contrarotating roller 24 in a direction in which the slat 31 advances.

Figure 9:
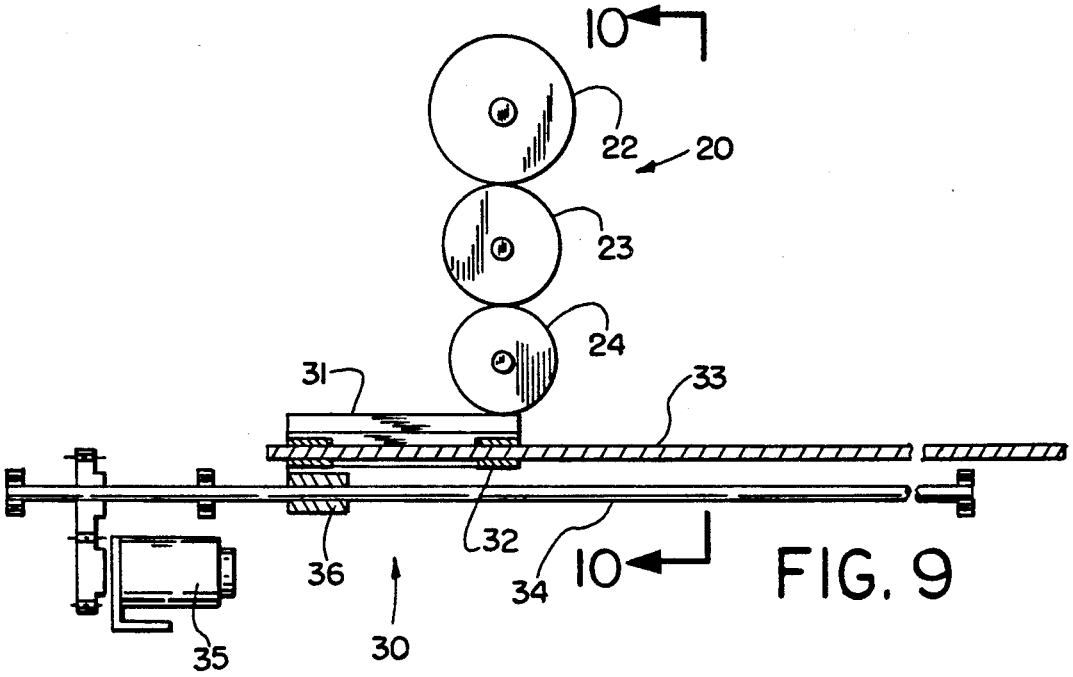
FIG. 9 is a sectional view of the capsule conveyor unit.
Figure 10:
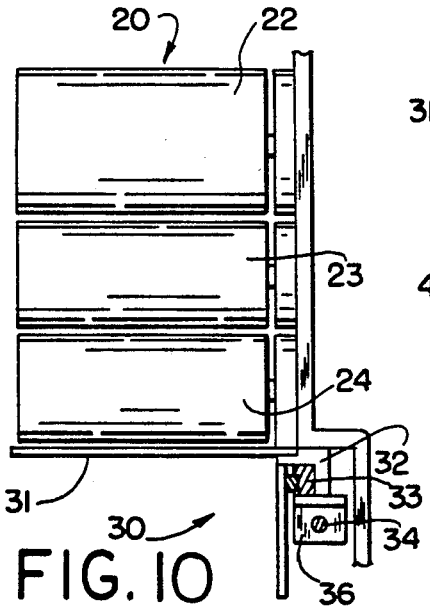
FIG. 10 is a sectional view taken along the line X—X in FIG. 9.

As shown in FIGS. 9 and 10, the capsule conveyor unit 30 that conveys the slat 31 has a support member 32 for supporting the slat 31 at only one side portion. The support member 32 engages a guide rail 33 horizontally extending in such a direction as to cut the axis of the contrarotating roller 24 at right angle, and is moved along the guide rail 33. A rotation axis 34 is disposed below and in parallel with the guide rail 33. The rotation axis 34 is rotated to and fro by a servomotor 35, and engaged with a moving block 36 which is linearly moved along the rotation axis 34 in accordance with the reciprocal rotation of the rotation axis 34. The support member 32 is attached to the moving block 36. Therefore, the reciprocating motion of the moving block 36 along the rotation axis 34 causes the slat 31 mounted on the support member 32 to reciprocate.

The slat 31 advances from one return point below the contrarotating roller 24 in the same direction as that in which the capsule accommodating pockets 24*a* moves at the same velocity so that each capsule resting slit 31*a* can successively meet the corresponding capsule accommodating pocket 24*a* reaching the lowermost part of the contrarotating roller 24. In this way, while the slat 31 advances below the contrarotating roller 24, capsules 10 with their bodies and caps aligned in the same direction, respectively, are successively discharged from the capsule accommodating pockets 24*a* into respective capsule resting slits 31*a*. The slat 31 which has passed below the contrarotating roller 24 further advances, and is moved in the same direction.

Figure 11:
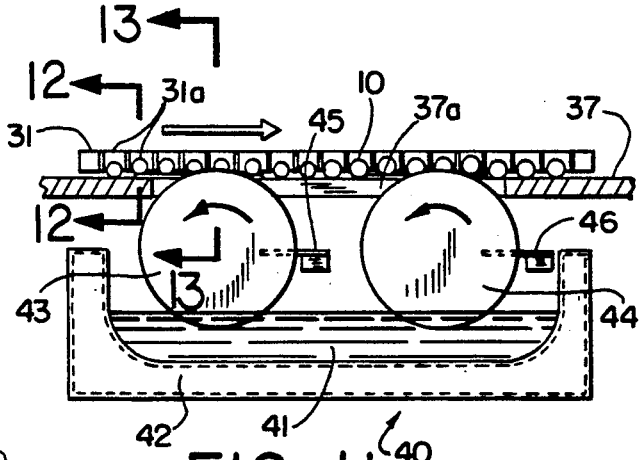
FIG. 11 is a side view showing a sealing device.
Figure 12:
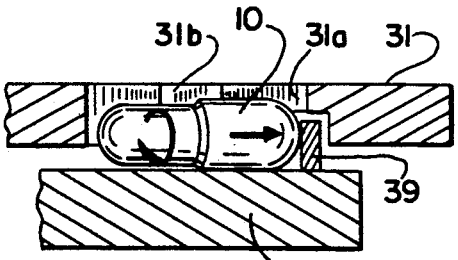
FIG. 12 is a sectional view taken along the line Y—Y in FIG. 11.
Figure 13:
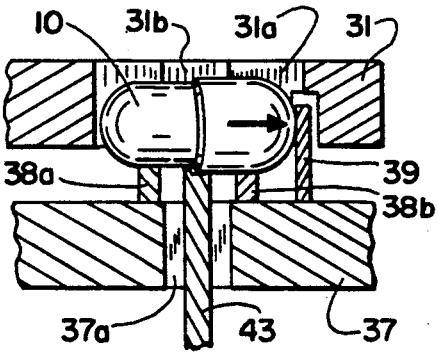
FIG. 13 is a sectional view taken along the line Z—Z in FIG. 11.

As shown in FIGS. 11 and 13, a plurality of slits 37*a* extending in a direction in which the slat 31 is moved is provided in the middle of the support plate 37 disposed in an area where the slat 31 is moved. Each slit 37*a* faces the middle of the corresponding capsule resting slit 31*a* arranged in a direction in which the slat 31 advances on the support plate 37.

As shown in FIG. 13, a pair of guide rods 38*a* and 38*b* are mounted on the support plate 37 so as to hold each slit 37*a* therebetween. Capsules 10 accommodated in capsule resting slits 31*a* are transferred onto the guide rods 38*a* and 38*b* in accordance with the movement of the slat 31, so that their bodies and caps of the capsules 10 come in contact with the guide rods 38*a* and 38*b*, respectively. A cap guide 39 is disposed on the support plate 37 so as to be in contact with the cap of each capsule 10 accommodated in the capsule resting slit 31*a* of the slat 31. The guide rod 38*b* positioned toward the cap guide 39 is lower than the guide rod 38*a* so as to be in contact with a cap. The cap guide 39 extends beyond both edges of each slit 37*a*.

A sealing device 40 is disposed below each slit 37*a* that seals capsules 10 accommodated in each capsule resting slit 31*a* of the slat 31. The sealing device 40 has almost the same configuration as that of conventional capsule sealing devices disclosed in Japanese Patent Publication No. 2-946 and Japanese Laid-Open Patent Publication No. 3-12160, and as shown in FIG. 11, has a vessel 42 for storing a sealing liquid 41. A coating roller 43 and a finish roller 44 that are rotated on respective axes orthogonal to the advancing route of the slat 31 are spaced at appropriate intervals along the route in the vessel 42. The coating roller 43 and the finish roller 44 are provided with a plurality of projecting sections each corresponding to the capsule resting slits 31*a* arranged in the direction of feed of the slat 31 and the openings 31*b* running through the capsule resting slits 31*a*. The lower part of the coating roller 43 and the finish roller 44 are immersed in the sealing liquid 41 in the vessel 42, and the upper part of the rollers 43 and 44 projects out of the support plate 37 through the slit 37*a* in the support plate 37 so as to fit between respective guide rods 38*a* and 38*b*. The coating roller 43 and the finish roller 44 are rotated so that the upper portion of the projecting sections projecting upwards out of the support plate 37 is moved in the opposite direction to feed of the slat 31. Therefore, capsules 10 in capsule resting slits 31*a* roll on the support plate 37 in accordance with the advancement of the slat 31, and comes into contact with the respective guide rods 38*a* and 38*b* when passing over the sealing device 40 so as to be coated with the sealing liquid 41 along the seams between their bodies and caps by the projecting sections of the coating roller 43 and finish roller 44, respectively.

The top face of the guide rods 38*a* and 38*b* curves in the shape of a circular arc having almost the same external diameter as that of the coating roller 43 and the finish roller 44. Therefore, capsules 10 continue to rotate on their axes due to contact with the guide rods 38*a* and 38*b* while passing the uppermost part of the coating roller 43 and the finish roller 44 projecting out of the support plate 37 through the slit 37*a*, permitting the capsules 10 to be sufficiently coated along the seams between their bodies and caps with the sealing liquid 41. Since the seams of the capsules 10 are positioned within the openings 31*b* of the slat 31, there is no possibility that the sealing liquid 41 applied along the seam may attach to the inside wall of the capsule resting slits 31*a*. Further, the longitudinal direction of the capsule resting slit 31*a* of the slat 31 slants to a direction in which the slat 31 advances, which allows capsules 10 accommodated therein to move toward their caps within the capsule resting slit 31*a* in accordance with the advance of the slat 31, and come in contact with the cap guide 39. This locates the capsules 10 and ensures that the seams between their bodies and caps are coated with the sealing liquid 41.

The sealing liquid 41 contained in the vessel 42 is prepared by, for example, dissolving gelatin in alcohols, and maintained at a prescribed temperature by a heating device (not shown). The amount of the sealing liquid 41 to be attached onto each circumferential surface of the coating roller 43 and the finish roller 44 is kept constant by scrapers 45 and 46 disposed within the vessel 42.

The slat 31 which has passed an area where the sealing device 40 is disposed is slid on the support plate 37 to convey capsules 10 in each capsule resting slit 31*a*. A drying device 50 is disposed adjacent to the edge at which the slat 31 stop advancing.

As shown in FIG. 2, the drying device 50 has an elevating device 56 disposed adjacent to the edge of the support plate 37 (FIG. 1), a plurality of capsule retaining plates 51 onto which all the capsules 10 conveyed on the slat 31 are transferred on the elevating devices 56, and a downward feed mechanism 52 and an upward feed mechanism 53 of each capsule retaining plate 51 disposed on each side of the elevating device 56.

Each capsule retaining plate 51 is a flat plate in almost the same form as the slat 31, and has a shallow groove extending along the length of the capsules 10 transferred onto the top face so that the transferred capsules 10 might not fall down.

As shown in FIGS. 15A to 15D, the elevating device 56 has a climbing plate 56*a* horizontally disposed adjacent to the support plate 37 of the slat 31. The climbing plate 56a is elevated with a capsule retaining plate 51 mounted thereon. A plurality of rods 56b and a rack gear 56c are vertically attached to the underside of the climbing plate 56a. Each rod 56b runs through a guide tube 56e on a fixed board 56d, and the rack gear 56c engages the pinion gear 56f rotated by an elevating motor 56g on the fixed board 56d. Therefore, the elevating motor 56g is driven in a reciprocal direction, which causes the climbing plate 56a to ascend and descend over the fixed board 56d.

The climbing plate 56a of the elevating device 56 is at a level slightly lower than the top face of the support plate 37 to support the slat 31 when elevated, and when the capsule retaining plate 51 is mounted on the climbing plate 56a, the capsule retaining plate 51 is at the same level as, and adjacent to the support plate 37. In this way, the slat 31 conveying many capsules 10 is moved from the support plate 37 onto the climbing plate 56a. Then, when the slat 31 is transferred onto the climbing plate 56a, the capsules 10 are fitted into the grooves in the capsule retaining plate 51. Accordingly, when the climbing plate 56a descends, all the capsules 10 retained on the slat 31 are transferred onto the capsule retaining plate 51 on the climbing plate 56a.

The downward feed mechanism 52 situated at one side of the elevating device 56 has a pair of tandem chains 52a vertically disposed as shown in FIG. 1. To each chain 52a is attached many supporting members 52b spaced at equal intervals in a longitudinal direction thereof. The supporting members 52b each attached to one chain 52a and another chain 52a face each other, and a capsule retaining plate 51 is horizontally supported between the supporting members 52b opposite each other. Then, the chains 52a are driven in synchronism with each other so that each capsule retaining plate 51 can descend successively based on the space between the plates 51 as one pitch. The other upward feed mechanism 53 (shown on the right side of FIG. 2) has the same configuration, so that the capsule retaining plates 51 horizontally accommodated therein and vertically spaced are successively transferred upwards.

As shown in FIGS. 14A to 14E, in both the downward feed mechanism 52 and the upward feed mechanism 53, when the capsule retaining plate 51 is elevated to the uppermost step, the underside of the plate 51 is on a level with the top face of the climbing plate 56a of the elevating device 56. A first transverse feed mechanism 54 is disposed close to the capsule retaining plate 51 situated at the uppermost step of the upward feed mechanism 53 so as to horizontally transfer the plate 51. Thus, the first transverse feed mechanism 54 transfers the capsule retaining plate 51 from the uppermost step of the upward feed mechanism 53 onto the climbing plate 56a of the elevating device 56, and further to the uppermost step of the downward feed mechanism 52. A second transverse feed mechanism 55 is disposed close to the capsule retaining plate 51 situated at the lowermost step of the downward feed mechanism 52. The second transverse feed mechanism 55 transfers the plate 51 to the lowermost step of the upward feed mechanism 53.

Figure 14A:
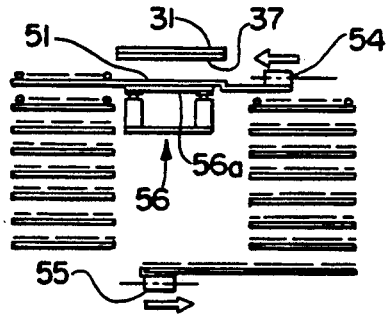
FIGS. 14A to 14E are front views exemplifying the operation of a capsule drying device.

FIG. 14A shows the case where the climbing plate 56a is in a lower position in the elevating device 56. In this case, the underside of the capsule retaining plate 51 is on a level with the top face of the climbing plate 56a so that the plate 51 situated at the uppermost step of the upward feed mechanism 53 is horizontally transferred onto the climbing plate 56a by the first transverse feed mechanism 54. In synchronism with the transfer of the plate 51 onto the climbing plate 56a, the second transverse feed mechanism 55 operates, which transfers the plate 51 situated at the lowermost step of the downward feed mechanism 52 to the lowermost step of the upward feed mechanism 53.

Figure 14C:
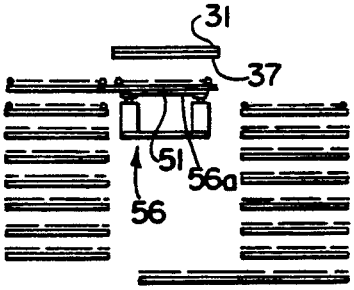
Figure 14B:
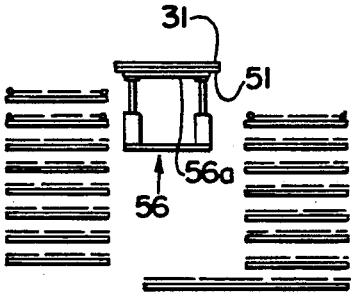
Figure 15A:
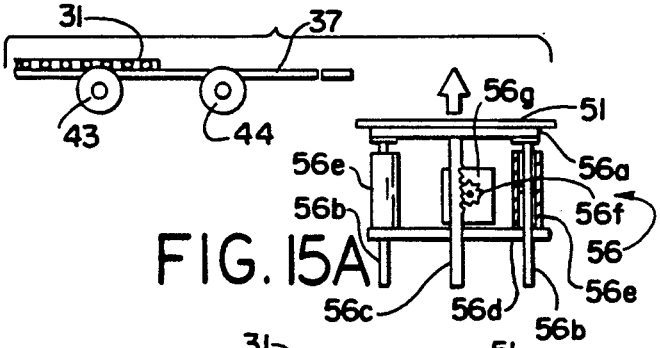
FIGS. 15A to 15D are side views exemplifying the operation of the capsule drying device.
Figure 15B:
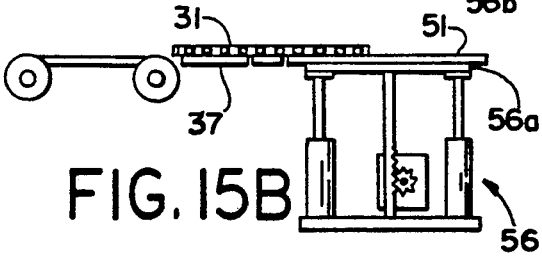

As shown in FIGS. 14B, 15A and 15B, when the capsule retaining plate 51 is transferred onto the climbing plate 56a, the climbing plate 56a ascends, which makes the capsule retaining plate 51 adjacent to the supporting plate 37 of the capsule conveyor unit 30. In this way, the slat 31 which has passed over the sealing device 40 is transferred from the supporting plate 37 onto the capsule retaining plate 51. This causes capsules 10 within each capsule resting slit 31a to be transferred from the supporting plate 37 onto the capsule retaining plate 51.

Figure 14D:
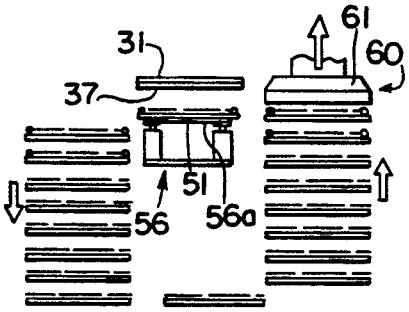
Figure 14E:
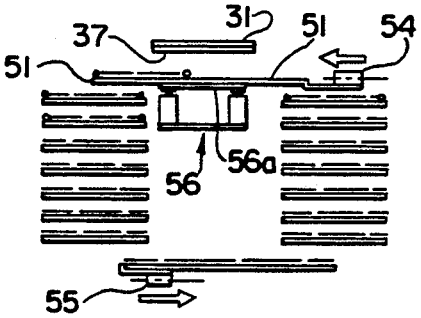
Figure 15C:
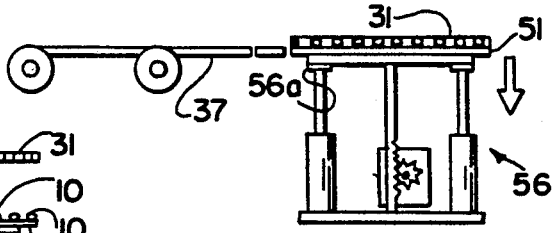
Figure 15D:
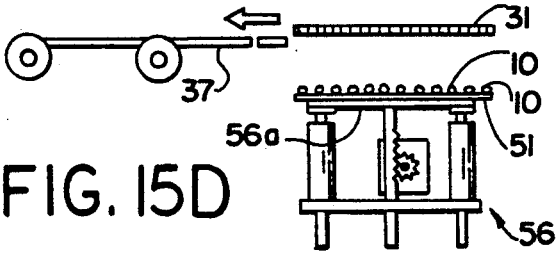

When the capsules 10 are transferred onto the capsule retaining plate 51 on the climbing plate 56a, the climbing plate 56a descends as shown in FIGS. 14C, 15C and 15D. Thus, the delivery of the capsules 10 from the capsule conveyor unit 30 to the drying device 50 is completed. Then, the slat 31 begins to withdraw, in the course of which each capsule retaining plate 51 within the downward feed mechanism 52 descends by a height corresponding to the vertical space between the plates 51, while each plate 51 within the upward feed mechanism 53 ascends by the same height as shown in FIG. 14D. As shown in FIG. 14E, the transverse feed mechanisms 54 and 55 then operate, which transfers the capsule retaining plate 51 with the capsules 10 thereon on the climbing plate 56a to the uppermost step of the upward feed mechanism 53, thus returning to the condition as shown in FIG. 14A.

The repetition of the above process successively transfers capsule retaining plates 51 with capsules 10 thereon into the downward feed mechanism 52, which in turn causes the plates 51 to successively descend, and further to be transferred into the upward feed mechanism 53, which in turn causes the plates 51 to successively ascend. During the travel, the sealing liquid applied along the seams between the bodies and caps of the capsules 10 on each capsule retaining plate 51 is dried.

Figure 16:
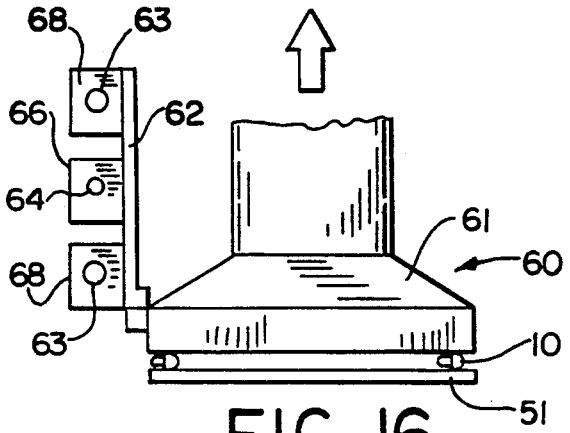
FIG. 16 is a front view showing a capsule discharging device.
Figure 17:
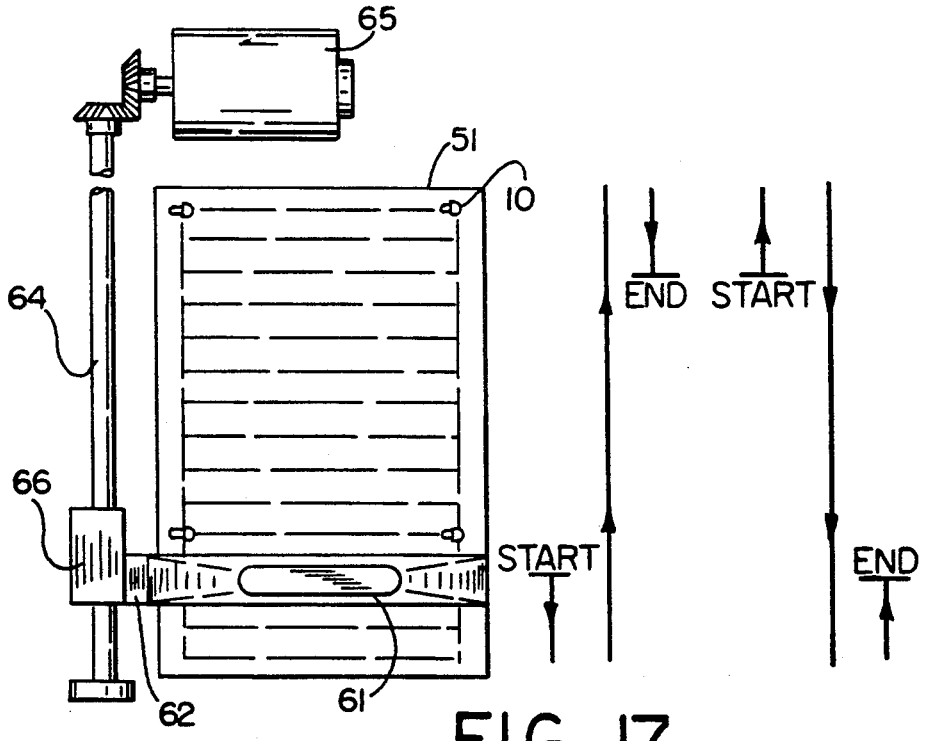
FIG. 17 is a front view showing the capsule discharging device.

A discharging device 60 for discharging the capsules 10 which have been sealed along the seam is disposed above the upward feed mechanism 53. The capsule discharging device 60 has a suction duct 61 opposite the top face of the capsule retaining plate 51 situated at the uppermost step of the upward feed mechanism 53 as shown in FIGS. 16 and 17. The suction duct 61 has a suction opening so as to cover the entire width of the capsule retaining plate 51 at its bottom. The distance between the lower edge of the suction opening and the capsule retaining plate 51 is slightly larger than the outside diameter of the caps of the capsules 10. The internal pressure of the suction duct 61 is reduced to such a pressure so as to suck the capsules 10 on the capsule retaining plate 51.

The suction duct 61 is supported only at one side by a supporting member 62 disposed at one side thereof and vertically extending. The supporting member 62 is provided with a pair of guide blocks 68 vertically spaced at appropriate intervals, and a moving block 66 situated between the guide blocks 68. The guide blocks 68 are slidably engaged with respective guide rods 63 vertically disposed and extending in a direction in which the slat 31 is moved. The moving block 66 is engaged with a rotation axis 64 in parallel with each guide rod 63. The rotation axis 64 is rotated to and fro by a motor 65, which moves the moving block 66 along the axis of the rotation axis 64. In this way, the suction duct 61 is moved as a whole in a direction in which the slat 31 is moved. As shown in FIG. 14D, each capsule retaining plate 51 is elevated to the uppermost step by the upward feed mechanism 53, immediately after which the suction duct 61 is moved along over the capsule retaining plate 51 with the internal pressure reduced, then the capsules 10 which have been sealed along the seam are sucked into the suction duct 61 and discharged out of the drying device 50. In this way, when all the capsules 10 are sucked into the suction duct 61, the capsule retaining plate 51 situated at the uppermost step of the upward feed mechanism 53 is transferred onto the climbing plate 56*a* of the elevating device 56.

In such a capsule sealing apparatus, a prescribed number of capsules 10 are successively supplied with their bodies and caps aligned in the same direction, respectively, from the capsule supplying device 20 to the capsule conveyor unit 30 at a time. The capsules 10 are then successively conveyed to the drying device 50 by the reciprocal motion of the slat 31. In this stage, the capsules 10 pass over the sealing device 40, during which the capsules 10 are coated along the seam with the sealing liquid. The capsules 10 conveyed into the drying device 50 are successively transferred onto the capsule retaining plate 51, and circulated within the drying device 50, in the course of which the sealing liquid applied on the seams of the capsules 10 is dried. The dried capsules 10 are successively discharged out of the drying device 50 by the capsule discharging device 60.

In the above process, in order to increase the number of capsules 10 to be sealed per hour, the number of the capsules 10 to be supplied from the capsule supplying device 20 into the capsule conveyor unit 30 per hour can be increased, or the time interval between feeds of the capsules 10 can be reduced. In the former case, if the size of the slat 31 and the number of the capsule resting slit 31*a* are increased, and the capsule retaining plate 51 having the corresponding size is used, the increased number of capsules 10 can readily be treated. In the latter case, if the travel speed of the slat 31 and the number of the capsule retaining plate 51 are increased, the length of time when the capsules 10 stay within the drying device 50 might not be reduced. Therefore, in spite of the fact that the capsules 10 are conveyed by one slat 31, the sealing capability of the apparatus is improved. Further, the capsule retaining plate 51 has a more simplified structure and can be produced at a lower cost as compared with the slat 31, hardly affecting the structure and the price of the capsule sealing apparatus. Since the capsule retaining plates 51 vertically circulate within the drying device 50, the drying device 50 can be decreased in size, reducing the size of the capsule sealing apparatus.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. A capsule sealing apparatus comprising:

a capsule supplying device for intermittently supplying a prescribed number of capsules aligned in the same direction at a time, each capsule including a cap and a body, and charged with contents with the cap closing the body;

a slat including a plurality of capsule resting slits for individually accommodating the capsules supplied from the capsule supplying device, each capsule resting slit including an opening at its bottom;

a capsule conveyor unit for linearly reciprocating the slat, the capsules supplied from the capsule supplying device being individually accommodated in respective capsule resting slits during the travel of the slat;

a capsule sealing device for coating the seams between their caps and bodies of the capsules individually accommodated in respective capsule resting slits with a sealing liquid through the openings at the bottoms of the slits in the slat, the capsule sealing device being disposed in an area where the slats are moved by the capsule conveyor unit;

a plurality of capsule retaining plates onto which all the capsules in each capsule resting slit of the slat are transferred, the plates horizontally being disposed at a return point of the slat;

a drying device for vertically circulating the capsule retaining plate with the charged capsules thereon in the horizontal posture so as to dry the sealing liquid applied on each capsule; and a capsule discharging device for discharging the capsules outside the drying device, the sealing liquid of the capsules being dried on the capsule retaining plate of the drying device.

2. A capsule sealing apparatus according to claim 1, wherein the capsule supplying device further comprises:

a supplying drum for retaining a prescribed number of capsules so that the capsules are arranged radially therewith without aligning their bodies and caps;

a regulating roller disposed in parallel with and below the supplying drum, and constructed so that the capsules retained in the supplying drum are vertically transferred thereto so as to be retained radially therewith in the circumferential surface, and capsules with their caps situated inside are caused to lie axially while they are in rotation;

a contrarotating roller disposed in parallel with and below the regulating roller, and constructed so that capsules retained in the regulating roller are vertically transferred thereto so as to be retained radially therewith in the circumferential surface, and the capsules are caused to lie so that their caps are aligned with the lying capsules while they are in rotation; and, a shutter disposed so as to be insertable into and withdrawable from an area where the capsules are moved from the supplying drum to the regulating roller, the shutter inserting into the moving area preventing the capsules from moving, the shutter being driven in synchronism with the reciprocating motion of the slat.

3. A capsule sealing apparatus according to claim 1, wherein the capsule conveyor unit includes a supporting plate for supporting capsules accommodated in respective capsule resting slits of the slat, and the slat is slid on the top face of the supporting plate so that each capsule rolls on the supporting plate.

4. A capsule sealing apparatus according to claim 3, wherein the drying device comprises;

an elevating device including a climbing plate disposed so that the capsule retaining plate is placed at the return point of the slat sliding on the supporting plate, and an elevating driving means for causing the top face of the capsule retaining plate placed on the climbing plate to ascend to the same level with the top face of the supporting plate and descend therefrom;

a first transverse feed mechanism for horizontally transferring the capsule retaining plate on the climbing plate sideways when the climbing plate of the elevating device is in a lower position;

a downward feed mechanism for successively transferring the capsule retaining plates downward which have been transferred to the uppermost step in a horizontal posture by the first transverse feed mechanism;

a second transverse feed mechanism for horizontally transferring the capsule retaining plates which have been transferred to the lowermost step of the downward feed mechanism; and an upward feed mechanism for successively transferring the capsule retaining plates which have been transferred to the lowermost step by the second transverse feed mechanism.

5. A capsule sealing apparatus according to claim 4, wherein the first transverse feed mechanism comprises means for transferring the capsule retaining plate from the uppermost step of the upward feed mechanism onto the climbing plate in a lower position.

6. A capsule sealing apparatus according to claim 5, wherein the capsule discharging device comprises means whereby it moves along the top face of the capsule retaining plate which reaches the uppermost step of the upward feed mechanism and sucks the capsules on the capsule retaining plate.

* * * * *